US005890772A

United States Patent [19]

Mravyan

[11] Patent Number: 5,890,772

[45] Date of Patent: Apr. 6, 1999

[54] GRINDING MACHINE FOR REMOVING MARKINGS FROM PAVED SURFACES AND GRINDER FOR THE SAME

[75] Inventor: Michael Mravyan, North York, Canada

[73] Assignee: Bartell Industries Inc., Brampton, Canada

[21] Appl. No.: 748,354

[22] Filed: Nov. 13, 1996

[51] Int. Cl.[6] ..... E01C 23/088

[52] U.S. Cl. ..... 299/41.1; 175/374; 451/352

[58] Field of Search ..... 299/39.9, 40.1, 299/41.1, 110; 175/374; 125/14; 451/350, 351, 352

[56] References Cited

U.S. PATENT DOCUMENTS

| | | | |
|---|---|---|---|
| 4,405,177 | 9/1983 | Yamashita | 299/41.1 |
| 4,523,361 | 6/1985 | Dummermuth | 29/81.05 |
| 4,634,188 | 1/1987 | Persson | 299/40.1 |
| 5,234,064 | 8/1993 | Lenaburg | 175/373 |
| 5,605,381 | 2/1997 | Schmoock, Jr. et al. | 299/41.1 X |

FOREIGN PATENT DOCUMENTS

| | | | |
|---|---|---|---|
| 0098798 | 1/1984 | European Pat. Off. . | |
| 0133961 | 3/1985 | European Pat. Off. . | |
| 2710140 | 10/1977 | Germany . | |
| 8911435.3 | 11/1989 | Germany . | |
| 174709 | 7/1989 | Japan | 299/41.1 |
| 9318235 | 9/1993 | WIPO . | |

OTHER PUBLICATIONS

Pavemark Publication—PM Eraser, Professional Pavement Makings Remover (undated).

Hiway Marking Systems, Leaders in the Pavement Marking Industry Introduces Another Quality Product "Roadline Eraser" CLC–15 (undated).

Traffic Line Remover, Parts Breakdown and Listing, Model TLR–7, Dated Jun. 1, 1988.

*Primary Examiner*—David J. Bagnell

*Attorney, Agent, or Firm*—Baker & Daniels

[57] ABSTRACT

A grinding machine to remove markings such as painted lines from a paved surface includes a wheeled carriage to be moved over the paved surface. A grinder is positioned beneath the carriage to contact and grind the paved surface. A suspension acts between the carriage and the grinder to allow the grinder to follow the profile of the paved surface as the grinding machine is moved thereover. A drive is supported by the carriage to actuate the grinder.

22 Claims, 4 Drawing Sheets

GRINDING MACHINE FOR REMOVING MARKINGS FROM PAVED SURFACES AND GRINDER FOR THE SAME

FIELD OF THE INVENTION

The present invention relates to grinding machines and in particular to a grinding machine to remove painted lines and other markings from paved surfaces and to a grinder for the same.

BACKGROUND OF THE INVENTION

Line erasing machines to remove painted lines and other markings from paved surfaces are known in the art. These line erasing machines may be of the walk-behind type which are moved by an operator walking behind the line erasing machine or of the self-propelled riding type on which an operator sits.

Walk-behind line erasing machines have a wheeled carriage beneath which is mounted a grinder having a plurality of radially extending grinding heads to contact the paved surface to be grinded. The grinding heads are maintained in a fixed plane relative to the carriage. A motor is supported on the carriage to actuate the grinder and rotate the grinding heads. A depth adjustment mechanism acts between the grinder and the carriage to allow the position of the grinder relative to the carriage to be adjusted. Conventional depth adjustment mechanisms allow the grinder to be moved to a desired position and then locked into that position. Thus, once the position of the grinder has been set, the plane of the grinding heads remains stationary with respect to the wheels of the carriage.

It is a well known fact that paved surfaces are not flat. Therefore, the grinders are locked in position with grinding heads maintained in a fixed plane relative to the carriage and the line erasing machine is wheeled over an uneven paved surface, one or more of the grinding heads may not be in constant contact with the paved surface as the grinding heads are rotated. This may require the operator to move the line erasing machine back and forth along the paved surface to be grinded until the marking is removed from the paved surface. Alternatively, the operator may stop the line erasing machine and reposition the grinder relative to the carriage by way of the depth adjustment mechanism to bring the grinding heads into contact with the paved surface. In either case, the time required to grind the paved surface is increased.

In addition, in some instances, because the grinding heads remain in a fixed plane relative to the carriage, if the paved surface is sufficiently uneven, the wheels of the carriage may be lifted from the paved surface by the grinding heads as they rotate and contact the paved surface. This may cause the line erasing machine to slide laterally from the marking on the paved surface requiring the operator to oscillate the machine back and forth across the paved surface until the marking is removed from the paved surface. Depending on the steering skill of the operator, the time taken to remove the marking from the paved surface will vary significantly. Accordingly, improved line erasing machines which overcome these disadvantages are sought.

It is therefore an object of the present invention to provide a novel grinding machine to remove markings from paved surfaces and a novel grinder for the same.

SUMMARY OF THE INVENTION

According to one aspect of the present invention there is provided a grinding machine to remove markings from paved surfaces comprising:

a wheeled carriage;

a grinder beneath said carriage to contact and grind a paved surface;

a suspension acting between said carriage and said grinder; and a drive supported by said carriage to actuate said grinder.

Preferably, the suspension provides for movement of the grinder relative to carriage to allow the grinder to follow the profile of the paved surface to be grinded. Specifically, the suspension allows the grinder to move vertically with respect to the carriage and allows the grinding plane of the grinder to pivot laterally.

In a preferred embodiment, the suspension is in the form of a parallelogram linkage. In this case, it is preferred that the carriage includes a main frame and a subframe carried by and movable relative to the main frame. The subframe supports the drive and the grinder and the parallelogram linkage acts between the subframe and the main frame.

Preferably, the grinding machine includes a lifting arm actuable to act on the subframe to lift the grinder from the paved surface. It is also preferred that the grinding machine includes a lock arm to maintain the grinder in the lifted position.

According to another aspect of the present invention there is provided a grinder assembly for a grinding machine to remove markings from paved surfaces, said grinding machine having a wheeled carriage supporting a drive, said grinder assembly comprising:

a grinder to be coupled to said drive and having a plurality of radially extending grinding heads to contact and grind said paved surface, said grinding heads being circumferentially spaced and being rotatable about an axis in response to said drive; and a suspension to act between said grinder and said wheeled carriage, said suspension allowing said grinding heads to follow the profile of said paved surface as said wheeled carriage is moved thereover.

According to still yet another aspect of the present invention there is provided a grinding element comprising:

a tubular body;

a plurality of longitudinally spaced, annular protrusions on an outer surface of said body separated by channels, each of said protrusions having an outer radial flank and an inner sloped flank, said inner slope flank being sloped so that the cross-sectional dimension of said inner flank is greater than the cross-sectional dimension of said outer flank; and a plurality of circumferentially spaced cutting bits carried by and projecting outwardly from said protrusions.

Preferably, the grinding element also includes an end cap on one end of the tubular body. Releasable fasteners are accommodated by countersunk holes in the end cap and engage with the protrusion adjacent the one end of the tubular body. It is also preferred that the configurations of the protrusions and channels is given by:

$$A/B=(0.9 \text{ to } 1.1)\cdot\tan(\propto)=B/A$$

where:

$\propto$ is the angle of the slope of the inner flanks;

A is the width of the tops of the protrusions; and

B is the width of the channels.

According to still yet another aspect of the present invention there is provided a grinding head for a grinding machine to remove markings from paved surfaces comprising:

a radial axle;

an internally lubricated tubular body carried by said axle and rotatable thereabout;

a plurality of longitudinally spaced, annular protrusions on an outer surface of said body separated by channels, each of said protrusions having an outer radial flank and an inner sloped flank, said inner flank being sloped so that the cross-sectional dimension of said inner flank is greater than the cross-sectional dimension of said outer flank; and a plurality of circumferentially spaced cutting bits carried by and projecting outwardly from said protrusions.

The present invention provides advantages in that since a suspension acts between the grinder and the carriage, the grinder is allowed to follow the profile of the paved surface as the grinding machine is moved over the paved surface. Thus, the grinding heads remain in constant contact with the paved surface eliminating the need for the grinding machine to be stopped and re-adjusted and moved back and forth along and/or back and forth across the markings on the paved surface to be removed. This of course reduces the time required to remove markings from paved surfaces.

BRIEF DESCRIPTION OF THE DRAWINGS

An embodiment of the present invention will now be described more fully with reference to the accompanying drawings in which.

DETAILED DESCRIPTION OF THE PREFERRED EMBODIMENT

Figure 1:
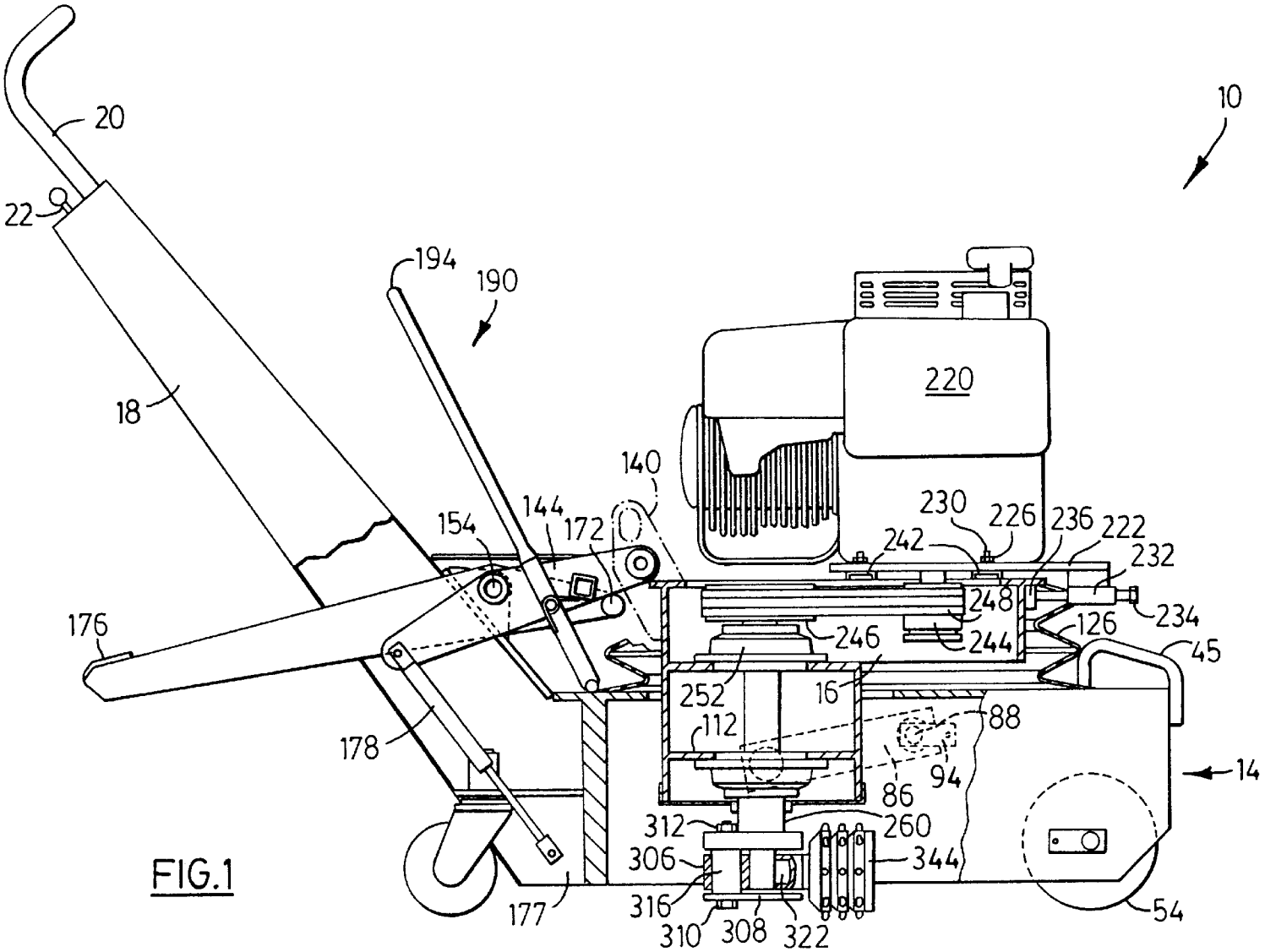
FIG. 1 is a side elevational view of a grinding machine to remove markings from a paved surface in accordance with the present invention.
Figure 2A:
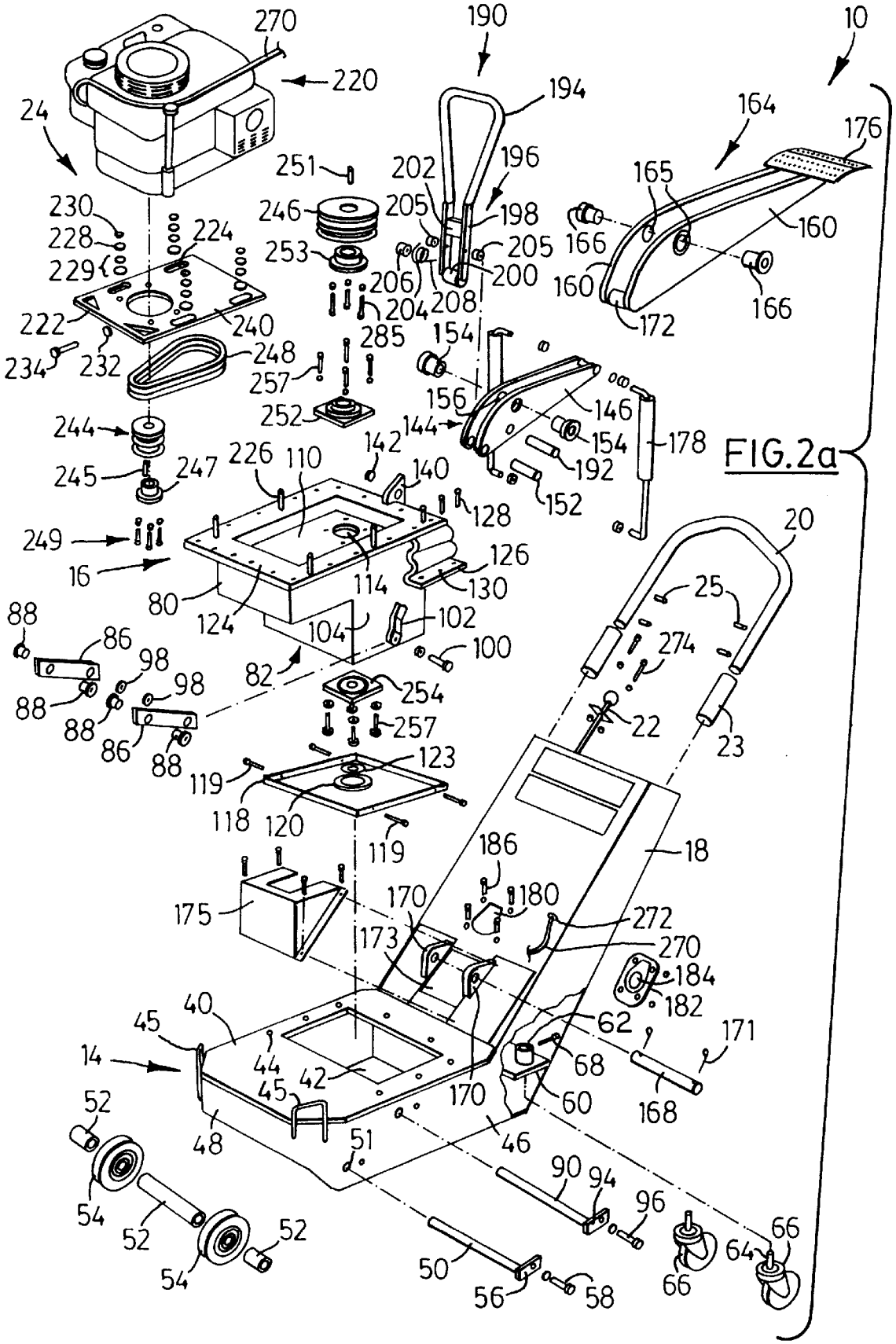
FIGS. 2*a* and 2*b* are exploded perspective views of the grinding machine of FIG. 1.
Figure 2B:
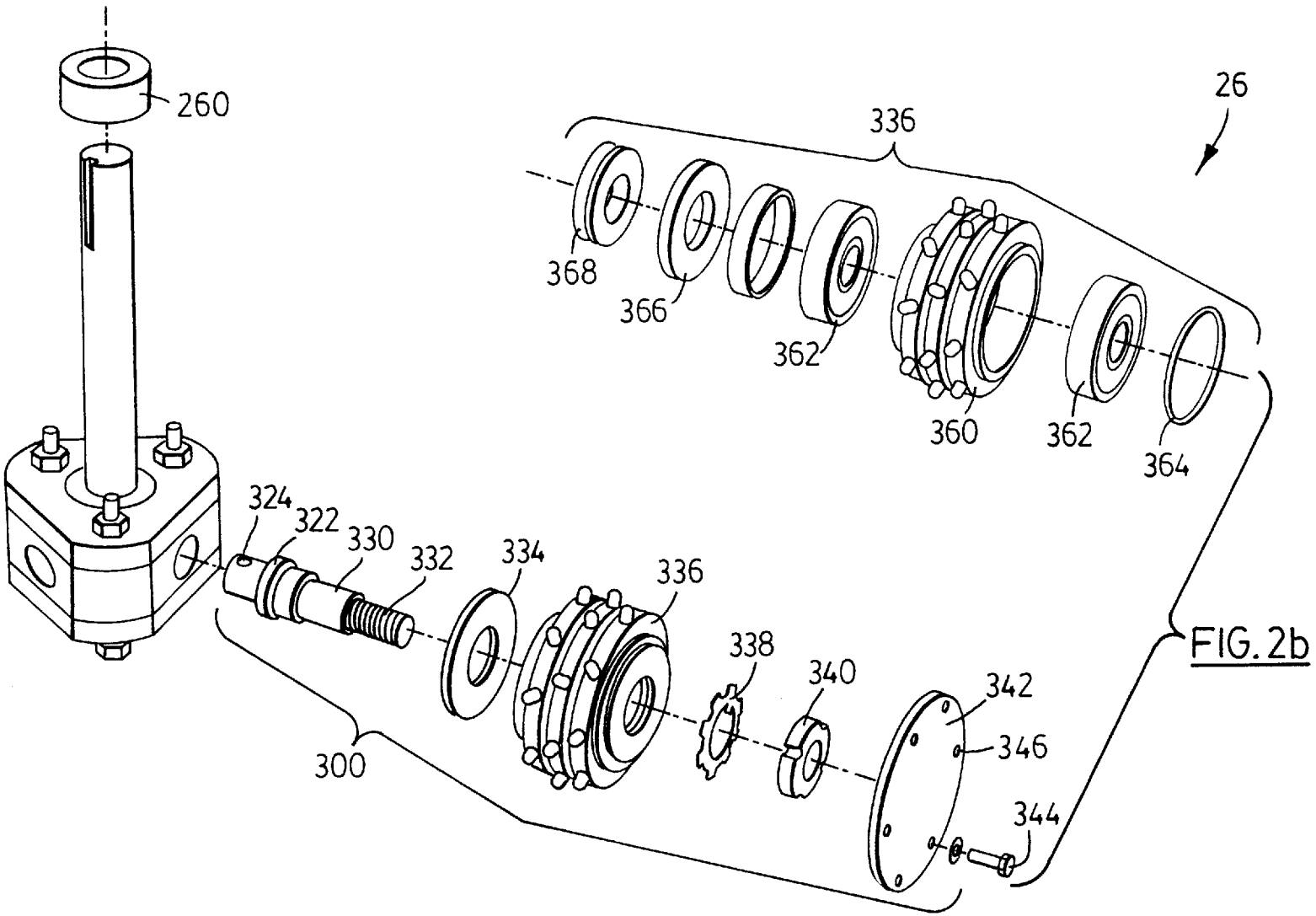

Referring now to FIGS. 1, 2*a* and 2*b*, a walk-behind grinding machine to remove markings such as painted lines from paved surfaces in accordance with the present invention is shown and is generally indicated to by reference numeral 10. Grinding machine 10 includes a wheeled carriage 12 constituted by a frame assembly including a main frame 14 and a subframe 16. Main frame 14 includes an upwardly and rearwardly extending console 18 that accommodates a U-shaped handle 20 and a throttle control 22. Sleeves 23 are provided on the ends of the handle 20 and are secured by pins 25. Supported on the carriage 12 is a drive 24 responsive to the throttle control 22. Beneath the carriage 12 is a grinder 26 to contact a paved surface and grind it to remove markings thereon. A suspension 28 acts between the grinder 26 and the carriage 12 to allow the grinder 26 to follow the profile of the paved surface as the grinding machine is rolled over the paved surface.

Main frame 14 is generally rectangular and includes a horizontal top plate 40 having a generally rectangular aperture 42 provided through it. A plurality of holes 44 are provided in the top plate 40 and surround the aperture 42. Lifting rings 45 are secured to the front corners of the main frame 14. Side walls 46 and a front wall 48 depend from the peripheral edges of the top plate 40. A stationary axle 50 extends between and passes through holes 51 (one of which is shown) in the side walls 46. The axle 50 also passes through spacers 52 positioned on opposite sides of a pair of non-steerable front guide wheels 54. A flange 56 on the end of axle 50 is secured to one of the side walls 46 by a fastener 58 in the form of a nut and bolt to inhibit rotation of the axle 50. A horizontal plate 60 extends rearwardly of the main frame 14 and is housed within the console 18. The plate 60 supports a pair of bushings 62 (one of which is shown). The bushings 62 receive the shafts 64 of a pair of rear caster wheels 66. Fasteners 68 pass through the bushings 62 and shafts 64 to secure the caster wheels 66 to the plate 60.

Subframe 16 includes a generally L-shaped tubular body 80. A portion 82 of the body passes through the aperture 42 and is accommodated within the main frame 14. The subframe 16 is hingedly connected to the main frame 14 by way of a pair of laterally spaced arms 86. Each arm 86 has a bushing 88 press-fitted into an aperture therein adjacent one of its ends. The bushings 88 accommodate a stationary rod 90 passing through holes 92 in the side walls 46 of main frame 14. The rod 90 has a flange 94 at one end which overlies one of the side walls 46. A fastener 96 in the form of a nut and bolt passes through the flange 94 to secure it to the side wall 46 inhibiting any rotational movement of the rod 90. Each arm 86 also has a rubber bonded bushing 98 press-fitted into an aperture therein adjacent the other of its ends. The rubber bonded bushings 98 accommodate fasteners 100 passing through angled brackets 102 welded to the side walls 104 of the subframe body 80. Since the rod 90 is stationary, the arms 86 are able to pivot independently about the rod relative to the main frame 14. Also, the shock absorbing nature of the rubber bonded bushings 98 allows for lateral misalignment between arms 86.

Within the body 80 are a pair of vertically spaced, horizontal plates 110, only one of which is shown, welded to the interior walls of the body. The plates 110 have aligned holes 114 provided therein. A dust cover 118 is removably secured to the bottom of the body 80 by fasteners 119 extending through the side walls 104 and protects the interior of the body from dust contamination. The dust cover 118 also has a hole 122 provided therein which is aligned with the holes 114 and 116 in the horizontal plates 110. A seat 120 on the dust cover 118 surrounds the hole 122 and accommodates an O-ring seal 123. A peripheral flange 124 is provided on the top of the body 80. A bellows 126 depends from the peripheral edge of the flange 124 and is secured to the main frame 14 by fasteners 128 passing through holes 130 in the bellows 126 that align with the holes 44 in the top plate 40.

A bracket 140 is welded to the rear wall of the subframe body 80 and accommodates a rubber bonded bushing 142. A rocker 144 comprised of a pair of laterally spaced plates 146 joined by a spacer (not shown) is hingedly connected to the bracket 140 adjacent one end by way of a pin 152 passing through the plates 146 and rubber bonded bushing 142. Similar to rubber bonded bushings 98, the shock absorbing nature of rubber bonded bushing 142 allows for some relative movement between the rocker 144 and bracket 140. Central bushings 154 extend between the plates 146 and are aligned with holes 156 in the plates 146. The rocker 144 is positioned between the side plates 160 of a lifting arm 164. Holes 165 in the side plates 160 accommodate bushings 166. The bushings 166 are aligned with the central bushings 154. A pivot pin 168 passes through the bushings 166 and central bushings 154 and extends between spaced brackets 170 on the console 18. The pivot pin 168 is retained by cotter pins 171.

The other end of the rocker 144 passes through a window 173 provided in the console 18 between the brackets 170. A cover 175 fastened to the console 18 surrounds the brackets 170 and rocker 144. The spacing between the side plates 160 is such to allow the rocker 144 and lifting arm 164 to swing about pivot pin 168 independently. Also, the distance between the hinged connection of the rocker 144 to the bracket 140 and the hinged connection of the rocker 144 to the brackets 170 is selected so that it is generally equal to the distance between hinged connection of the arms 86 to the main frame 14 and the hinged connection of the arms 86 to the brackets 102 on subframe 16. In this manner, the arms 86 and rocker 144 form a parallelogram linkage acting between the main frame 14 and subframe 16. A window 180 is provided in the console 18 above the brackets 170. A lifting plate 182 having an aperture 184 therein overlies the console and window and is secured to the console 18 by fasteners 186. The aperture 184 and lifting rings 45 accommodate hooks to allow the grinding machine 10 to be picked up and transported to a desired location.

A jack 172 spans the side plates 160 at the forward end of the lifting arm 164 and is positioned beneath the rocker 144 adjacent the bracket 140. The rear ends of the side plates 160 are spanned by a foot pedal 176. Gas springs 178 accommodated within the console 18 extend between the ends of side plates 146 of rocker 144 and plates 177 depending from plate 60 (see FIG. 1).

A locking arm 190 is pivotally connected to rocker 144 by way of a pivot pin 192 extending between side plates 146 and is movable between a rearwardly inclined disengaged position and an upright forward engaged position shown by dotted lines in FIG. 1. Cotter pins (not shown) passing through the ends of the pivot pin 192 restrain axial mount of the pivot pin. The locking arm 190 includes a handle 194 and a stop lock 196 secured to the distal end of the handle 194. The stop lock 196 includes a pair of laterally spaced flat bars 198 spanned by a cross pin 200 at their free ends and through which pivot pin 192 passes. A crossbar 202 also spans the flat bars 198 above the cross pin 200 and pivot pin 192. A torsion spring 204 is positioned between the flat bars 198 and accommodates the pivot pin 190. Spacers 205 are positioned between the flat bars 198 and side plates as well as within the torsion spring 204 and accommodate the pivot pin 190. One arm 206 of the torsion spring 204 contacts the crossbar 202 while the other arm 208 of the torsion spring 204 contacts the spacer 150 extending between side plates 146 of rocker 144.

The drive 24 includes a gas powered engine 220 supported by a mounting plate 222 and retained thereon by fasteners. The mounting plate 222 has a plurality of longitudinal slots 224 in it which accommodate studs 226 projecting upwardly from the flange 124. The studs 226 pass through anti-vibration shocks 228 and washers 224 and accommodate lock nuts 230 which threadably engage the studs to secure the mounting plate 222 to the subframe 16. A nut 232 is welded to the undersurface of the mounting plate 222 adjacent its front end and accommodates an adjustment screw 234. The adjustment screw 234 abuts a stop 236 on the body 80 of subframe 16 beneath the flange 124 (see FIG. 1).

A hole 240 is provided in the mounting plate 222 and allows the drive shaft 242 of the engine 220 to pass. A pulley 244 is secured to the drive shaft 242 by way of a key 245 and a taper lock bushing 247 attached to the pulley 244 by fasteners 249. Pulley 244 is coupled to another pulley 246 by way of a belt 248. The pulley 244 is secured to a vertical drive shaft 250 by way of a key 251 and a taper lock bushing 253 attached to the pulley 246 by fasteners 255. Vertical drive shaft 250 passes through the subframe 16 by way aligned holes 114, 116 and 122 in the horizontal plates 110 and 112 and dust cover 118. Flange bearings 252 and 254 are secured to the horizontal plates 110 and 112 by fasteners 257 to facilitate rotation of the vertical drive shaft 250 within the subframe 16. The tension of the belt 248 can be adjusted by tightening screw 234 so that it abuts stop 236 and causes mounting plate 222 to slide longitudinally over the top of the subframe 16. A stop spacer 260 (see FIG. 2*b*) surrounds the vertical drive shaft 250 just below the dust cover to inhibit upwardly longitudinal movement of the drive shaft 250. A cable 270 extends from the motor 220, passes through a hole 272 in the console 18 and terminates at the throttle control 22. The throttle control 22 is secured to the console by fasteners 274 and can be moved into and out of the console to control the throttle of the engine to adjust the rotations per minute of the drive shaft 242.

Figure 3:
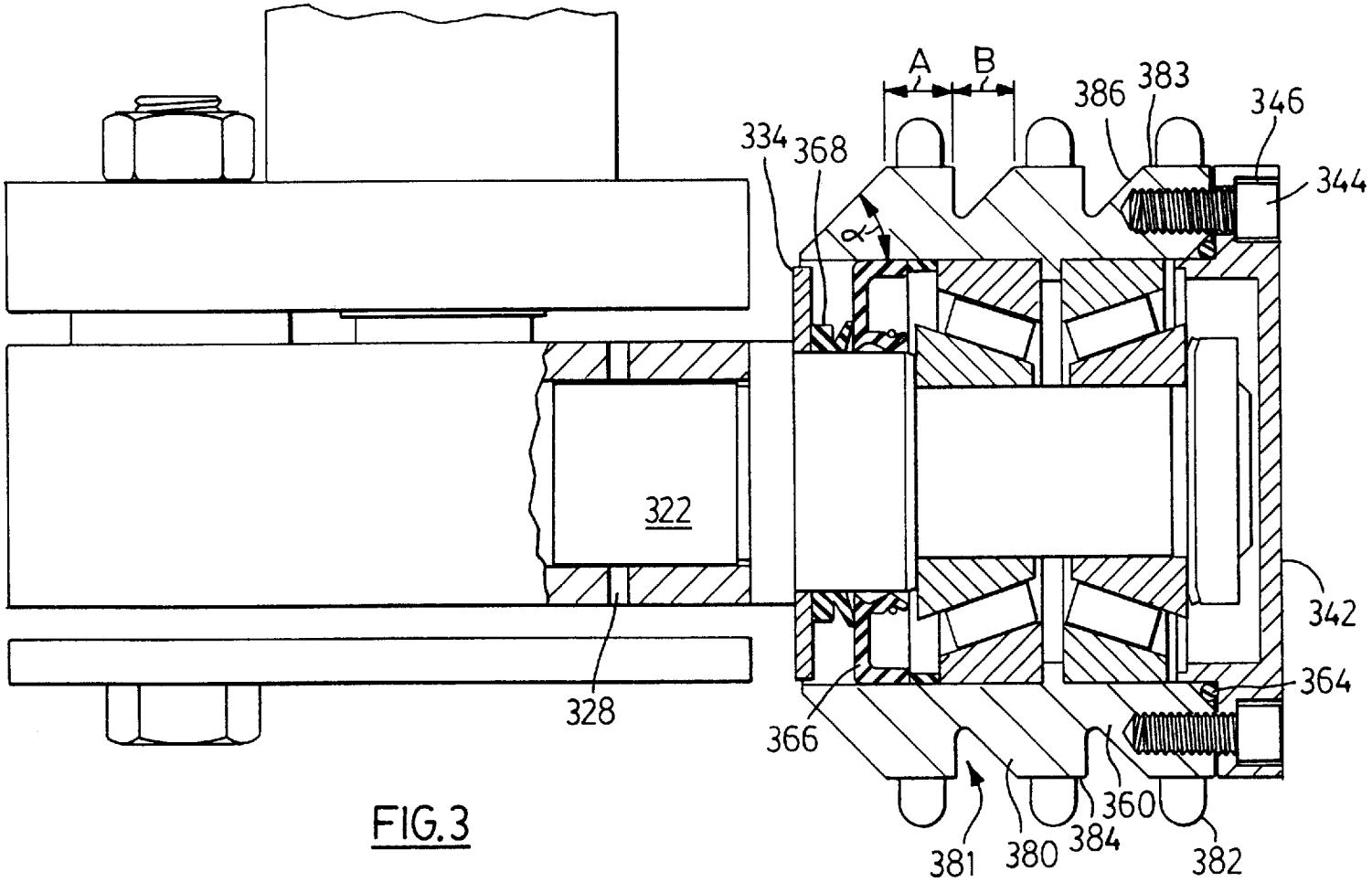
FIG. 3 is an enlarged cross-sectional view of a grinding head forming part of the grinding machine of FIG. 1.

The grinder 26 (best shown in FIGS. 2*b* and 3) is mounted on the end of the vertical drive shaft 250 and includes a plurality of grinding heads 300 extending radially outwardly from a support 302 at circumferentially spaced locations. The support 302 is welded to the vertical drive shaft 250 and in this embodiment, is of the type manufactured by EDCO Corporation. The support 302 includes top and bottom plates 304 and 306 fastened together by nuts and bolts 308 and which trap a hub 310 therebetween. Although not shown, shock absorbing bushings act between the hub and top and bottom plates to provide for the smooth transmission of torque from the drive shaft 250 to the grinder 26. The major sides of the support 302 have bores 320 provided therein which accommodate the ends of radial axles 322. The ends of radial axles have holes 324 provided therein which align with small holes (not shown) in the hub 306. Retaining roller pins (not shown) in the support 302 retain the radial axles 322.

Each radial axle 322 includes an annular stop 325, a pair of different diameter shanks 328 and 330 and a threaded distal end 332. A flange washer 334 is pressed onto shank 328 and abuts stop 325. A tubular grinding element 336 accommodates the radial axle 322 and a lock washer 338 and lock nut 340 engage the threaded distal end 332 of the radial axle to secure the grinding element 336 to the radial axle with the flange washer 334 acting between the stop 325 and the inside end of the grinding element 336. An end cap 342 is secured to the outside end of the grinding element 336 by fasteners 344 and encloses the lock nut 340 and washer 338 within the grinding element. The fasteners 344 are accommodated by countersunk holes 346 in the end cap 342 to inhibit aggregate from wearing or loosening the fasteners 344.

The grinding element 336 includes a generally cylindrical tubular body 360 having a pair of tapered roller bearings 362 press-fitted therein to allow body 360 to rotate about the radial axle 322. The bearings 362 are supported by shank 330. An O-ring 364 is seated on the interior surface of the end cap 342 and seals the join between the end cap 342 and the body 360. A spacer 365 and seal 366 are seated on the shank 328. Seal 366 is protected by a V-ring 368 on shank 328 which acts between the seal 366 and the flange washer 334. The interior of the grinding element 336 is filled with lubricant such as oil. The seal 366 and O-ring 364 inhibit leakage of the lubricant along the radial axle 322 and through the join between the body 360 and the end cap 342.

The outer surface of the body 360 has a plurality, in this example three, spaced annular protrusions 380 thereon defining channels 381 between the protrusions. Tungsten-carbide bits 382 extend radially outwardly from the protrusions 380 at spaced locations about the entire circumference of the protrusions. The bits 382 are soldered into holes 383 drilled into the tops of the protrusions. Each protrusion 380 is defined by an outer radial flank 384 and an inner sloped flank 386. Preferably, the configuration of the protrusions 380 and channels 381 is such that:

$$A/B=(0.9 \text{ to } 1.1)\cdot\tan(\propto)=B/A$$

where:

$\propto$ is the angle of the slope of the inner flank;

A is the width of the top of the protrusion; and

B is the width of the channel.

The increased cross-sectional dimension of the protrusion 380 towards the support 302 provides for increased support for the bits 382 from the side at which the structural integrity of the protrusions typically fail as compared to conventional grinding elements. This helps to reduce structural failure of the grinding elements 336. Also, the configuration of the channels 381 between the protrusions 380 helps to reduce dust build-up thereby providing for better heat convection resulting in an increased bearing and seal lifetime. In addition, the total cross-sectional dimension of the outermost protrusion 380 provides the room sufficient to allow the fasteners 344 to be accommodated in countersunk holes 346 in the end cap 342 unlike the fasteners in conventional grinding elements which stick out of the end cap. As mentioned previously, since the fasteners 344 are hidden in the countersunk holes, wearing or loosening of the fasteners 344 due to contact with asphalt particles resulting in subsequent lubricant leakage which may result in bearing failure, is inhibited.

The operation of the grinding machine 10 will now be described. When the locking arm 190 is in the retracted disengaged position, the weight of the engine 220, subframe 16 and grinder 26 together with the downward force provided by the gas springs 178, provides a constant downward force on the grinder 26 to maintain the grinding heads 300 in constant contact with the paved surface having markings thereon to be removed. When the engine 220 is turned on and adjusted to full rotations per minute (rpms) by an operator via the throttle control 22, the engine shaft 242 imparts rotation of the vertical drive shaft 250 by way of pulleys 244 and 246 and belt 248. Rotation of the vertical drive shaft 250 in turn imparts rotation of the support 302 thereby rotating the grinding heads 300 so that the tungsten-carbide bits 382 on the grinding elements 336 sweep a grinding plane and contact and grind the paved surface removing the marking thereon.

When the marking on the portion of the paved surface that has been grinded by the grinding elements 336 has been removed, the grinding machine 10 is pushed forwardly by an operator. As the grinding machine 10 is wheeled over the paved surface, the parallelogram linkage acting between the main frame 14 and subframe 16 allows the grinder 26 to follow the longitudinal and lateral profile of the paved surface even when the paved surface is uneven thereby maintaining the grinding elements 336 in constant contact with the paved surface. This is achieved in part by selecting the distance between the hinged connection of the rocker 144 to the bracket 140 on the subframe 16 and the hinged connection of the rocker 144 to the brackets 170 on the console 18 to be equal to the distance between the hinged connection of the arms 86 to the main frame 14 and the hinged connection of the arms 86 to the brackets 102 on the subframe 16. The grinding machine 10 is thus moved forwardly along the paved surface over the marking to be removed until the complete marking has been removed from the paved surface.

When it is desired to transport the grinding machine 10, the grinder 26 is lifted from the paved surface by applying downward pressure on the foot pedal 176 of lifting arm 164 causing the lifting arm 164 to pivot about pivot pin 168. As this occurs, the jack 172 contacts and pivots the rocker 144 causing the bracket 140 to lift. This in turn causes the subframe 16 to move upwardly carrying the grinder 26 with it. At the same time, as rocker 144 is pivoted, the torsion spring 204 acting between the cross bar 202 and spacer 150 causes the stop arm 190 to pivot forwardly about pivot pin 192 to the forward engaged position. When the pedal 176 is released, the stop arm 190 is retained in an over-center position by the console 18 keeping the subframe 16 and hence grinder 26 in a lifted position spaced from the paved surface. The grinding machine 10 can then be wheeled to its desired location. To return the grinder 26 into contact with the paved surface, it is necessary to apply downward pressure to the pedal 170 to cause jack 172 to pivot the rocker 144 and lift the bracket 140 and take the weight off the stop arm 190 allowing the stop arm 190 to be pulled back to the retracted disengaged position via handle 194.

Although the present invention has been described with reference to a walk-behind grinding machine, it is equally applicable to grinding machines of the self-propelled riding type. In this case, a hydraulic pump can be mounted on top of engine 220 and a hydraulic motor installed on the main frame to drive the front wheels. Different kinds of hydraulic and electro-hydraulic control elements well known to those of skill in the art can be implemented providing coordination between motion of grinding machine and the position of the subframe and grinder relative to the main frame.

Those of skill in the art will also appreciate that other variations and modifications may be made to the present invention without departing from the spirit and scope thereof as defined by the appended claims.

I claim:

1. A grinding machine for removing markings from paved surfaces comprising:

a carriage including a wheeled main frame and a subframe accommodated by said main frame and moveable relative thereto;

a drive including a motor mounted on said carriage and a generally vertical drive shaft coupled to said motor and extending through said subframe;

a grinder coupled to said drive shaft beneath said carriage to contact and grind a paved surface, said grinder including a plurality of grinding heads at spaced locations, each of said grinding heads being radially spaced from said drive shaft, said grinding heads being rotated by said drive shaft to sweep said grinding heads in a plane generally orthogonal to the longitudinal axis of said drive shaft; and a suspension acting between said subframe and said main frame, said suspension accommodating movement of said subframe relative to said main frame in a direction parallel to said longitudinal axis and accommodating tilting of said subframe relative to said main frame to tilt said drive shaft and thereby tilt the plane in which said grinding heads are swept to allow said grinder to follow the profile of said paved surface.

2. A grinding machine as defined in claim 1 wherein said suspension includes a parallelogram linkage acting between said main frame and said subframe.

3. A grinding machine as defined in claim 2 wherein said parallelogram linkage includes a first pair of laterally spaced arms, each spaced arm being hingedly coupled at one end thereof to a forward end of said main frame and hingedly coupled at another end thereof to a side of said subframe, and a rocker hingedly coupled to a rear end of said subframe and to a rearwardly and upwardly extending console forming part of said main frame.

4. A grinding machine as defined by claim 3 wherein the distance between the hinged connection of said rocker to said subframe and the hinged connection of said rocker to said console is selected so as to be generally equal to the distance between the hinged connection of said spaced arms to said main frame and the hinged connection of said spaced arms to said subframe.

5. A grinding machine as defined in claim 4 further comprising shock absorbing bushings acting between said spaced arms and subframe and between said rocker and subframe.

6. A grinding machine as defined in claim 5 wherein said grinding machine is of the walk-behind type and wherein said motor is mounted on said subframe.

7. A grinding machine as defined in claim 1 further including a lifting arm pivotally mounted on said main frame and having one end acting on said subframe, said lifting arm being pivotal to move said subframe upwardly relative to said main frame to lift said grinder from a paved surface.

8. A grinding machine as defined in claim 7 further comprising a lock arm to maintain said grinder in a lifted condition.

9. A grinding machine as defined in claim 1 wherein each of said grinding heads includes a radial axle extending from a hub attached to said drive shaft; an internally lubricated tubular body carried by said axle and rotatable thereabout; a plurality of longitudinally spaced annular protrusions on an outer surface of said body separated by channels, each of said protrusions having an outer radial flank and an inner sloped flank, said inner flank being sloped so that the cross-sectional dimension of said inner flank is greater than the cross-sectional dimension of said outer flank; and a plurality of circumferentially spaced cutting bits carried by and projecting outwardly from said protrusions.

10. A grinding machine as defined in claim 9 wherein the configuration of said protrusions is given by:

$$A/B=(0.9 \text{ to } 1.1)\cdot\tan(\propto)=B/A$$

where:

$\propto$ is the angle of the slope of said inner flanks;

A is the width of the tops of said protrusions; and

B is the width of the channels.

11. A grinding element comprising:

a tubular body;

a plurality of longitudinally spaced, annular protrusions on an outer surface of said body separated by channels, each of said protrusions having an outer radial flank and an inner sloped flank, said inner slope flank being sloped so that the cross-sectional dimension of said inner flank is greater than the cross-sectional dimension of said outer flank; and a plurality of circumferentially spaced cutting bits carried by and projecting outwardly from said protrusions wherein the configuration of said protrusions is given by:

$$A/B=(0.9 \text{ to } 1.1)\cdot\tan(\propto)=B/A$$

where:

$\propto$ is the angle of the slope of said inner flanks;

A is the width of the tops of said protrusions; and

B is the width of the channels.

12. A grinding element as defined in claim 11 further comprising an end cap on one end of said tubular body and releasable fasteners accommodated by countersunk holes in said end cap and engageable with the protrusion adjacent said one end of said tubular body.

13. A grinding head for a grinding machine to remove markings from paved surfaces comprising:

a radial axle;

an internally lubricated tubular body carried by said axle and rotatable thereabout;

a plurality of longitudinally spaced, annular protrusions on an outer surface of said body separated by channels, each of said protrusions having an outer radial flank and an inner sloped flank, said inner flank being sloped so that the cross-sectional dimension of said inner flank is greater than the cross-sectional dimension of said outer flank; and a plurality of circumferentially spaced cutting bits carried by and projecting outwardly from said protrusions wherein the configuration of said protrusions is given by:

$$A/B=(0.9 \text{ to } 11)\cdot\tan(\propto)=B/A$$

where:

$\propto$ is the angle of the slope of said inner flanks;

A is the width of the tops of said protrusions; and

B is the width of the channels.

14. A grinding head as defined in claim 13 further comprising an end cap on one end of said tubular body and releasable fasteners accommodated by countersunk holes in said end cap and engageable with the protrusion adjacent said one end of said tubular body.

15. A grinding head for a grinding machine to remove markings from paved surfaces comprising:

a radial axle;

an internally lubricated tubular body carried by said axle and rotatable thereabout;

a plurality of longitudinally spaced, annular protrusions on an outer surface of said body separated by channels, each of said protrusions having an outer radial flank and an inner sloped flank, said inner flank being sloped so that the cross-sectional dimension of said inner flank is greater than the cross-sectional dimension of said outer flank;

a plurality of circumferentially spaced cutting bits carried by and projecting outwardly from said protrusions; and an end cap on one end of said tubular body and releasable fasteners accommodated by countersunk holes in said end cap and engageable with the protrusion adjacent said one end of said tubular body.

16. A grinding machine for removing markings from paved surfaces comprising:

a wheeled carriage;

a grinder beneath said carriage to contact and grind a paved surface;

a suspension acting between said carriage and said grinder; and a drive supported by said carriage and including a generally vertical, rotatable drive shaft to actuate said grinder wherein said grinder includes a plurality of spaced grinding heads extending radially outwardly from said drive shaft, each of said grinding heads including a radial axle extending from a hub attached to said drive shaft; an internally lubricated tubular body carried by said axle and rotatable thereabout; a plurality of longitudinally spaced annular protrusions on an outer surface of said body separated by channels, each of said protrusions having an outer radial flank and an inner sloped flank, said inner flank being sloped so that the cross-sectional dimension of said inner flank is greater than the cross-sectional dimension of said outer flank; and a plurality of circumferentially spaced cutting bits carried by and projecting outwardly from said protrusions.

17. A grinding machine as defined in claim 16 wherein the configuration of said protrusions is given by:

$$A/B=(0.9 \text{ to } 1.1)\cdot\tan(\propto)=B/A$$

where:

$\propto$ is the angle of the slope of said inner flanks;

A is the width of the tops of said protrusions; and

B is the width of the channels.

18. A grinding machine for removing markings from paved surfaces comprising:

a carriage including a wheeled main frame and a subframe accommodated by said main frame and moveable relative thereto;

a drive supported by said carriage;

a grinder coupled to said drive beneath said carriage to contact and grind a paved surface; and a suspension acting between said subframe and said main frame to accommodate movement of said grinder to allow said grinder to follow the profile of said paved surface, said suspension including a parallelogram linkage constituted by a first pair of laterally spaced arms each being hingedly coupled at one end thereof to the forward end of said main frame and hingedly coupled at an opposite end thereof to a side of said subframe, and a rocker hingedly coupled to a rear end of said main frame and to a rearwardly and upwardly extending console forming part of said main frame.

19. A grinding machine as defined by claim 18 wherein the distance between the hinged connection of said rocker to said subframe and the hinged connection of said rocker to said console is selected so as to be generally equal to the distance between the hinged connection of said spaced arms to said main frame and the hinged connection of said spaced arms to said subframe.

20. A grinding machine as defined in claim 19 further comprising shock absorbing bushings acting between said spaced arms and subframe and between said rocker and subframe.

21. A grinding machine as defined in claim 18 wherein said drive includes a motor mounted on said subframe and a generally vertical, rotatable drive shaft extending through said subframe and coupled to said grinder, said grinder including a plurality of spaced grinding heads extending radially outwardly from said drive shaft, each of said grinding heads including a radial axle extending from a hub attached to said drive shaft; an internally lubricated tubular body carried by said axle and rotatable thereabout; a plurality of longitudinally spaced annular protrusions on an outer surface of said body separated by channels, each of said protrusions having an outer radial flank and an inner slope flank, said inner flank being sloped so that the cross-sectional dimension of said inner flank is greater than the cross-sectional dimension of said outer flank; and a plurality of circumferentially spaced cutting bits carried by and projecting outwardly from said protrusions.

22. A grinding machine as defined in claim 21 wherein the configuration of said protrusions is given by:

$$A/B=(0.9 \text{ to } 1.1)\cdot\tan(\propto)=B/A$$

where:

$\propto$ is the angle of the slope of said inner flanks;

A is the width of the tops of said protrusions; and

B is the width of the channels.

* * * * *

UNITED STATES PATENT AND TRADEMARK OFFICE

CERTIFICATE OF CORRECTION

PATENT NO. : 5,890,772

DATED : April 6, 1999

INVENTOR(S) : Michael Mravyan

It is certified that error appears in the above-identified patent and that said Letters Patent is hereby corrected as shown below:

Claim 13, Col. 10, Line 23, delete "11" and insert --1.1--.

Signed and Sealed this

Twenty-first Day of September, 1999

*Attest:*

Q. TODD DICKINSON

*Attesting Officer*

*Acting Commissioner of Patents and Trademarks*